United States Patent [19]

Ishii et al.

[11] 4,417,722

[45] Nov. 29, 1983

[54] VACUUM FURNACE FOR HEAT TREATMENT

[75] Inventors: Hiroshi Ishii, Tokyo; Hiroshi Morii; Saburo Ishijima, both of Yokohama, all of Japan

[73] Assignee: Japan Oxygen Co., Ltd., Tokyo, Japan

[21] Appl. No.: 386,797

[22] Filed: Jun. 9, 1982

[30] Foreign Application Priority Data

Dec. 23, 1980 [JP] Japan ..... 55/182679

[51] Int. Cl.[3] ..... C21D 1/74; F27B 9/14

[52] U.S. Cl. ..... 266/250; 432/239

[58] Field of Search ..... 266/250; 432/205, 203, 432/239

[56] References Cited

U.S. PATENT DOCUMENTS

| | | | |
|---|---|---|---|
| 2,023,126 | 12/1935 | Fahrenwald | 432/239 |
| 2,028,479 | 1/1936 | Spicer | 432/239 |
| 2,189,983 | 2/1940 | Harris | 432/239 |
| 2,507,076 | 5/1950 | Wilde | 432/239 |
| 3,014,708 | 12/1961 | Helin | 266/250 |
| 3,124,634 | 3/1964 | Westeren et al. | 266/250 |
| 3,606,287 | 11/1969 | Bielefeldt | 266/250 |
| 3,778,221 | 12/1973 | Bloom | 266/250 |

*Primary Examiner*—L. Dewayne Rutledge
*Assistant Examiner*—Robert McDowell
*Attorney, Agent, or Firm*—Cantor and Lessler

[57] ABSTRACT

A vacuum furnace for heat treatment comprises a heating furnace proper, pre-exhaust chambers, one adapted to feed a workpiece into the furnace proper therefrom and the other adapted to discharge the workpiece out of the oven proper thereinto, vacuum valves for partitioning between the oven proper and the respective pre-exhaust chambers, and a line assembly for deliver of the workpiece from the feed chamber into the discharge chamber through the furnace proper. A heating chamber forming part of the furnace proper is positioned on the upper part above the deliver line assembly, and an externally operable elevating means is disposed in the furnace proper. The work pieces carried by the delivery line assembly, and lifted to the heating chamber where it is heated.

6 Claims, 3 Drawing Figures

VACUUM FURNACE FOR HEAT TREATMENT

BACKGROUND OF THE INVENTION

The present invention relates to a vacuum furnace for heat treatment of workpieces and materials.

In general, vacuum furnaces are used for melting or brazing of a metal workpiece such as an aluminum workpiece. This is primarily due to the fact that the metal may be oxidized by atmospheric oxygen with the workpiece itself or its junction being deteriorated as a consequence. As shown in FIG. 1, a typical example of the vacuum furnace available for this purpose is constructed from horizontally extending, cylindrical bodies, viz., a furnace proper 1, a pre-exhaust chamber 3 adapted to feed workpieces therethrough and put in communication within the furnace proper 1 through a partitioning vacuum valve 2, and a pre-exhaust chamber 4 adapted to discharge the workpieces therefrom and put in communication within the furnace proper 1 through a partitioning vacuum valve 2'. Within and across the furnace proper 1, there is an line assembly 5 for delivering the workpieces.

During the treatment of a workpiece A, both valves 2 and 2' are closed to maintain the furnace proper 1 independent and the chambers 3, 4 in an air-tight condition, whilst the furnace proper 1 is maintained in a given vacuum condition and preheated to a suitable temperature in normal state. After a door 6 is opened to deliver the workpiece A into the pre-exhaust chamber 3 and closed, the chamber 3 is evacuated to a degree of vacuum substantially equal to that prevailing in the furnace proper 1. The vacuum valve 2 is then opened to communicate the pre-exhaust chamber 3 with the furnace proper 1. Thereupon, the workpiece A is fed from the chamber 3 into the furnace proper 1, and the vacuum valve 2 is closed to cut off communication between the furnace proper 1 and the pre-exhaust chamber 3. Subsequently, the furnace proper 1 is brought to a desired high temperature under the given vacuum to work or treat the workpiece A. After the given heat treatment is completed, the vacuum valve 2' is opened to communicate the furnace proper 1 with the pre-exhaust chamber 4 exhausted in advance to the degree of vacuum prevailing in the furnace proper 1. The workpiece A is then fed from the furnace proper 1 into the pre-exhaust chamber 4 by means of the delivery line assembly 5. After the communication between the furnace proper 1 and the pre-exhaust chamber 4 is cut off by manipulation of the valve 2', the chamber is brought to an atmospheric pressure, and the workpiece A is carried out from the arrangement by opening a door 7.

In the arrangement as referred to above, the heating furnace proper 1 is arranged on a level with the pre-exhaust chamber 3 and 4. As a result, the partitioning vacuum valves 2 and 2', which are also arranged on a level with the furnace proper 1, are exposed directly to radiant heat, and heated while the furnace is operated. In this connection, it is noted that convection poses no problem under vacuum. As a result, the valves may be subject to deformation, or their sliding parts may lose their lubricating properties, so that difficulties are encountered both in closing and opening thereof and in the keeping of air-tightness. There may also be certain deformation of the delivery line assembly such as a conveyor or chain block assembly for delivery of a workpiece A from the chamber 3 into the chamber 4 through the furnace proper 1. This interferes with the running of the furnace from a practical point of view, and becomes increasingly marked, especially when the furnace is of a larger size.

SUMMARY OF THE INVENTION

A main object of the present invention is therefore to provide a solution to the above-mentioned problems.

According to the present invention, this object is achieved by the provision of a vacuum furnace for heat treatment comprising a heating furnace proper, pre-exhaust chambers, one adapted to feed a workpiece into the furnace proper and the other adapted to discharge the workpiece out of the furnace proper, vacuum valves for partitioning air-tightly between the furnace proper and the respective pre-exhaust chambers, and a delivery line assembly for delivery of the workpiece form the feed chamber into the discharge chamber through the furnace proper, wherein a heating chamber forming part of said furnace proper is positioned on the upper part above said delivery line assembly, and an externally operable elevating means is disposed in said furnace proper, said workpiece being carried by said delivery line assembly, and being lifted to said heating chamber where it is heated.

With the arrangement according to the present invention, there is no radiation heat of high temperature striking directly upon the vacuum valves provided along the delivery line, with the result that neither thermal distortion of the delivery line nor thermal deformation of the valves takes place. This ensures that the delivery line is always driven in a proper state, opening and closing of the valves are always driven with no difficulty, the valves are maintained in a satisfactorily air-tight condition, etc.

BRIEF DESCRIPTION OF THE DRAWINGS

This and other objects and features of the present invention will become apparent from a reading of the following detailed description with reference to the accompanying drawings, in which.

DETAILED DESCRIPTION OF THE INVENTION

Figure 1:
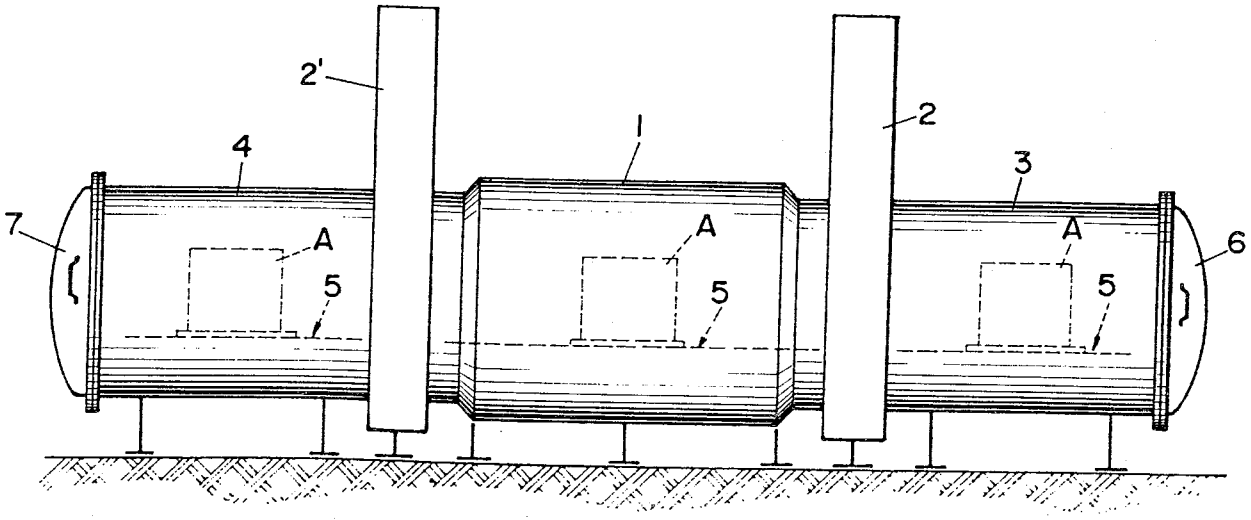
FIG. 1 PRIOR ART
FIG. 1 is a view illustrative of the prior art heating furnace for continuous operation.

The vacuum furnace for heat treatment according to the present invention is common to the prior art arrangement in that it is constructed from horizontally extending, cylindrical bodies, viz., a furnace proper 101, a pre-exhaust chamber 3 adapted to feed a workpiece therethrough and put in communication within the furnace proper 101 through a partitioning vacuum valve 2, and a pre-exhaust chamber 4 adapted to discharge the workpiece therefrom and put in communication within the furnace proper 101 through a partitioning vacuum valve 2', a delivery line assembly **5*a* formed as a conveyor belt, rail, roll or ball bearing or the like is mounted on the inner bottom of the furnace proper 101, the chamber 3 and the chamber 4, and the chambers 3 and 4 are provided with doors 6 and 7**, respectively, which can be closed air-tightly.

Figure 2:
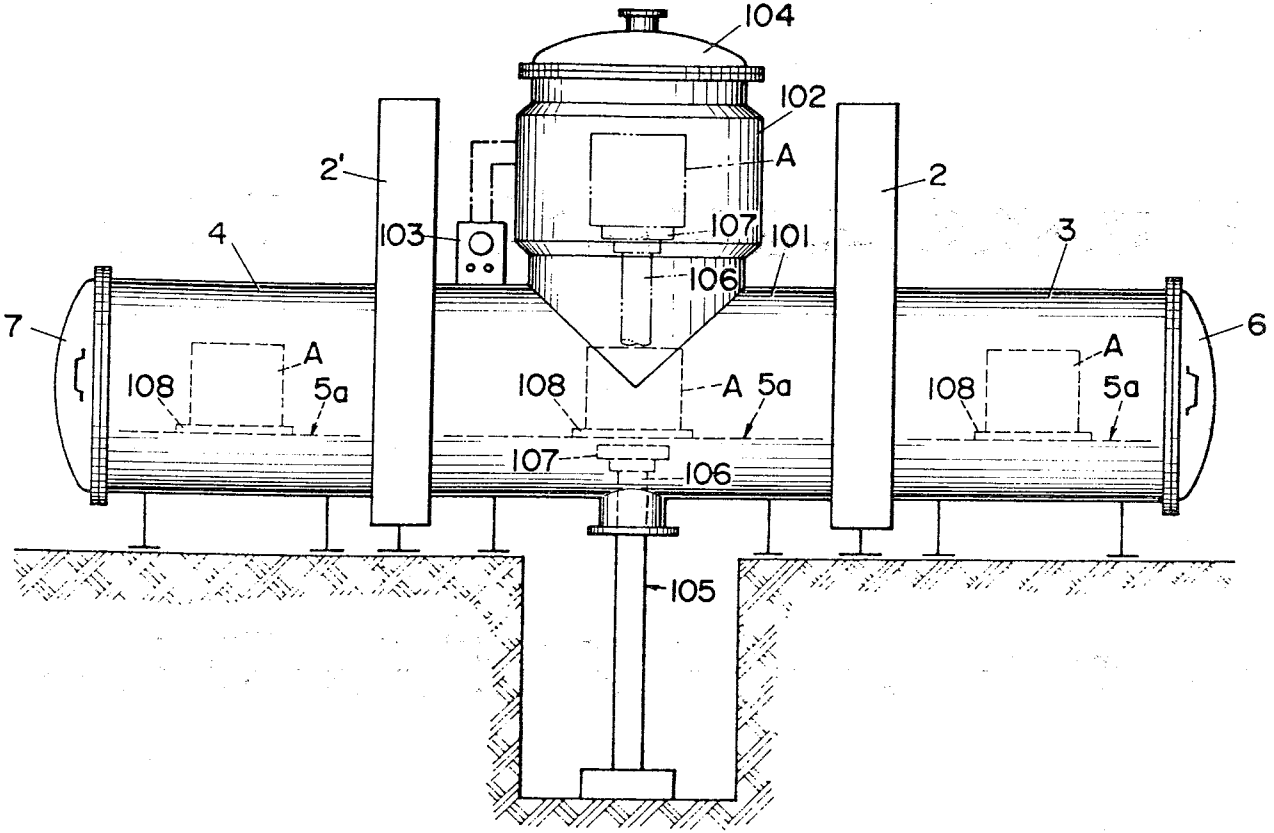
FIG. 2 is a view illustrative of the vacuum furnace for heat treatment for continuous operation according to the present invention.

The present invention is distinguished over the prior art in the following points, as will be appreciated from FIGS. 2 and 3. The furnace proper 101 is air-tightly provided thereon with a heating chamber 102 of a hollow and cylindrical member. Within the heating chamber 102, there is a known heating means such as an electric heater (not shown). This means is connected with an external temperature controller 103. The top portion of the heating chamber 102 is air-tightly fitted with a covering 104.

An elevating device 105 is hermetically mounted through the bottom of the furnace proper 101, and is ascendable or descendable substantially along the axial line of the heating chamber.

The elevating device 105 comprises an elevating shaft 106 and a table 107 mounted on top thereof. The elevating shaft 106 has its lower end coupled to a known driving device such as a hydraulic device (not illustrated). It is understood that the table 107 is of such a size that it can pass between a pair of rails 5*a* and 5*a* forming the delivery line 5. A car truck 108 bears a workpiece A thereon, and is movable on the rails within the chamber 3, the furnace proper 101 and the chamber 4. For instance, the car truck 108 is constructed from a framework 110 defining an opening 109, through which the elevating shaft 106 is vertically movable together with the table on which the workpiece A is supported.

Figure 3:
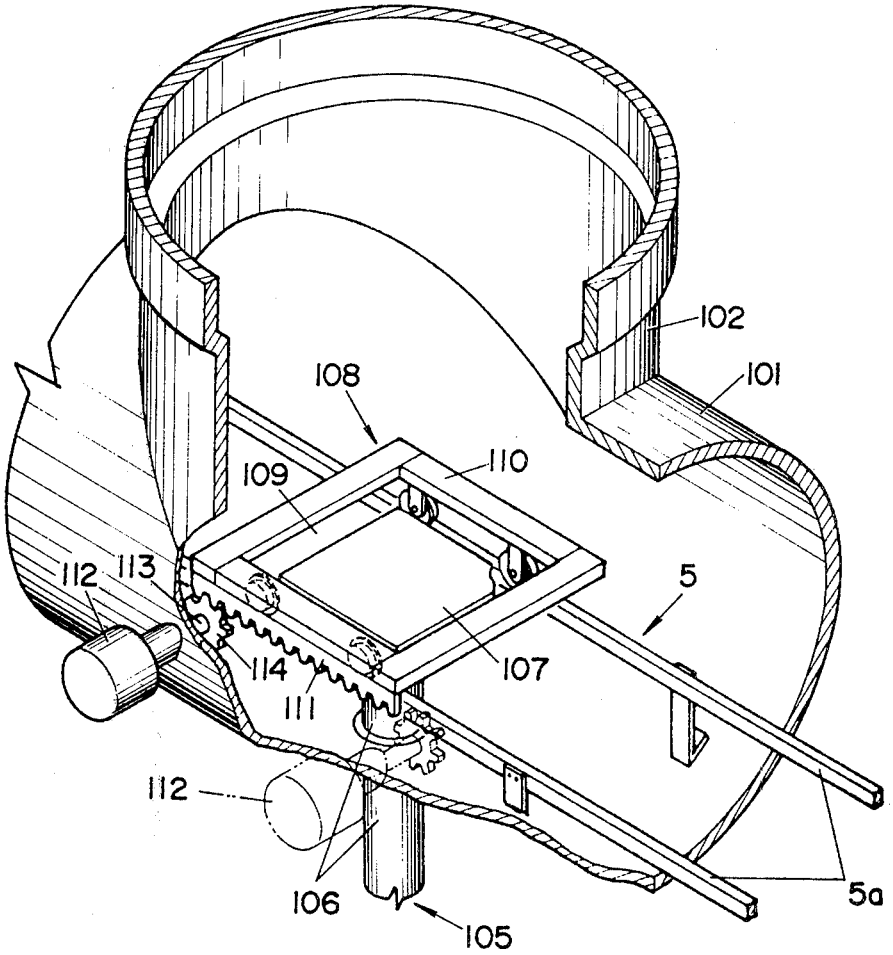
FIG. 3 is a partially cut away, enlarged view showing part of the furnace proper of the heating furnace arrangement according to the present invention.

As shown in FIG. 3 as an example, a driving mechanism for the car truck 108 may comprises a number of toothed rails 111 on the under surface of framework 110 extending in parallel along one rail 5*a* and a plurality of gears 114 to mate therewith thereby forming a rack and pinion. Each gear 114 is fixed to one end of a shaft 113 provided hermetically through the side wall of the chamber 3, the furnace proper 101 and the chamber 4. The shaft 113 is connected at the other end with a driving motor 112. The number of the gears 114 are dependent upon the length of the car truck 108 and may be chosen in such a manner that the car truck 108 can continuously be run on the rails 5*a* with no difficulty.

The heating furnace of the vacuum type according to the present invention operates as follows.

In operation, both valves 2 and 2' are air-tightly closed to cut off communications between the furnace proper 101 and the respective chambers 3 and 4. The furnace proper 101 is then maintained in the desired vacuum condition by a vacuum exhaust device (not shown), and the heating chamber 102 is controlled to a given temperature by the temperature controller 103. Subsequently, the door 6 is opened to introduce the workpiece A in the chamber 3 and place it on the car truck 108 disposed in advance therein, followed by closing of the door 6. The chamber 3 is then evacuated to vacuum by a vacuum exhaust device (not shown), and after the degree of vacuum substantially equal to that prevailing in the furnace proper 101 is reached, the valve 2 is opened. A plurality of driving motors 112 as shown in FIG. 3, are sequentially driven to turn the gears 114, whereby the truck 108 is moved on the rails 5*a*. As a result, the workpiece A is carried to just above the elevating device 105 positioned in the furnace proper 101. Thereupon, the valve 2 is closed, and the elevating device 105 is driven to lift the workpiece A to a given position in the heating chamber 102. The heating chamber 102 is heated to a given internal temperature by manipulation of the temperature controller 103, at which the workpiece A is treated. Although the heating chamber 102 may reach a temperature of as high as 500° C. the heat conduction occurring in this process is virtually only due to radiation since the furnace proper 101 including the heating chamber 102 is under vacuum. The arrangement in which the heating chamber 102 is disposed on the upper part above the delivery line 5 does not substantially permit the heat of the heating chamber 102 to conduct to the delivery line 5 owing to radiation. Accordingly, the workpiece A disposed in the heating chamber 102 is effectively heated. As mentioned above, the amount of heat radiating from the heating chamber 102 to the delivery line 5 is reduced, and the radiation heat from the heating chamber 102 does not strike upon the partitioning vacuum valves 2 and 2'. This makes it possible to prevent deformation of the valves 2 and 2' due to heat, so that they can be manipulated in a constantly stabilized state and in a good air-tight condition.

Upon heated in the heating chamber 102, the workpiece A is caused to return on the car truck 108 by the elevating device 105. Subsequently, the valve 2' is opened to form communication between the furnace proper 101 and the chamber 4 exhausted in advance to the degree of vacuum substantially equal to that prevailing in the furnace proper 101. The driving motors 112 are sequentially driven to move the car truck 108 on the rails 5*a*, whereby the workpiece A is carried from the furnace proper 101 into the pre-exhaust chamber 4. The valve 2' is closed to cut off communication between the chamber 4 and the furnace proper 101, and the chamber 4 is brought to an atmospheric pressure. The door 7 is then opened to carry out the workpiece A from the chamber 4.

If the above-mentioned procedures are repeated, a number of workpieces are then continuously heat-treated under vacuum.

While the delivery line has been described as comprising a pair of rails, it is understood that as the delivery line, other known means such as belt conveyors, chain blocks, roll or ball bearing may be used, if required.

What is claimed is:

1. A vacuum furnace for heat treatment comprising a heating furnace proper, pre-exhaust chambers, one adapted to feed a workpiece into the furnace proper therefrom and the other adapted to discharge the workpiece out of the furnace proper thereinto, vacuum valves for partitioning between the furnace proper and the respective pre-exhaust chambers, and a line assembly for delivery of the workpiece from the feed chamber into the discharge chamber through the furnace proper, wherein a heating chamber forming part of said furnace proper is raised above said delivery line assembly, and an externally operable elevating means is disposed in said furnace proper, said workpiece being carried by said delivery line assembly, and being lifted to said heating chamber where it is heated.

2. The arrangement of claim 1 wherein said delivery line assembly comprises a pair of rails.

3. The arrangement of claim 1 wherein said delivery line assembly comprises a conveyor, chain block or roll or ball bearing means.

4. The arrangement of claim 1 wherein said elevating means comprises an elevating shaft having one end coupled on a driving means, and a table fixed on top of the other end of said shaft.

5. The arrangement of claim 1 or 2 wherein a car truck bearing the workpiece thereon is movable on said rails.

6. The arrangement of claim 5 wherein the said car truck is driven by a number of teeth cutting on the undersurface under the framework of the car truck extending in parallel along one of said rails and gears to mate therewith, thereby forming a rack and pinion, said gears being fixed to one end of a plurality of shafts provided hermetically through the side wall of said furnace proper and said pre-exhaust chambers, and said shafts being connected at their other ends with the driving motors.

* * * * *